US006119770A

United States Patent [19]

Jaber

[11] Patent Number: 6,119,770

[45] Date of Patent: Sep. 19, 2000

[54] TRAPPED PARTICLE HEAT TRANSFER TUBE

[75] Inventor: M. Hassib Jaber, Williamsville, N.Y.

[73] Assignee: UOP LLC, Des Plaines, Ill.

[21] Appl. No.: 08/762,549

[22] Filed: Dec. 9, 1996

[51] Int. Cl.[7] ..... F28F 13/18; F28F 1/12

[52] U.S. Cl. ..... 165/181; 165/133

[58] Field of Search ..... 165/133, 181–184, 165/911, DIG. 516, DIG. 518

[56] References Cited

U.S. PATENT DOCUMENTS

| | | | |
|---|---|---|---|
| 3,684,007 | 8/1972 | Ragi | 165/133 |
| 3,881,342 | 5/1975 | Thorne | 72/68 |
| 4,286,655 | 9/1981 | Trojani | 165/179 |
| 4,678,029 | 7/1987 | Sasaki et al. | 165/133 |

FOREIGN PATENT DOCUMENTS

| | | | |
|---|---|---|---|
| 222100 | 5/1987 | European Pat. Off. | 165/133 |
| 52-11465 | 1/1977 | Japan | 165/133 |
| 54-17559 | 2/1979 | Japan | 165/133 |
| 56-113996 | 9/1981 | Japan | 165/133 |
| 56-155395 | 12/1981 | Japan | 165/133 |
| 59-100398 | 6/1984 | Japan | 165/133 |
| 60-66094 | 4/1985 | Japan | 165/133 |
| 61-291895 | 12/1986 | Japan | 165/133 |

*Primary Examiner*—Allen J. Flanigan

*Attorney, Agent, or Firm*—Thomas K. McBride; John G. Tolomei

[57] ABSTRACT

An arrangement for a heat exchange surface in a boiling application that retains particulate material between fins to provide nucleate boiling sites. The heat exchange surface most typically is part of a heat exchange tube and retains the particulate material by transversely extending the tops of the fins. The fins and extended tops form channels with a restricted opening at the top of the channel that prevents passage of the particulate material out of the channel. The surface may be formed on the inside or outside of tubes.

21 Claims, 1 Drawing Sheet

TRAPPED PARTICLE HEAT TRANSFER TUBE

FIELD OF THE INVENTION

This invention relates generally to methods and apparatus for indirect heat exchange. More specifically, this invention relates to indirect heat exchange where one heat transfer surface is a boiling surface.

BACKGROUND OF THE INVENTION

The use of enhanced boiling surfaces, and in particular nucleate boiling surfaces to increase the heat transfer film coefficient on boiling side heat transfer surfaces are well-known.

U.S. Pat. No. 4,769,511 discloses the use of an enhanced nucleate boiling surface to improve the operation of a process for the alkylation of isoparaffins. The use of nucleate boiling surfaces to improve the operation of heat exchange equipment in the reforming of hydrocarbons is disclosed in U.S. Pat. No. 5,091,075.

Enhanced boiling surfaces for use in heat exchange tubes are well known. Applications and details of tube arrangements are further discussed in U.S. Pat. Nos. 3,384,154, 3,821,018, 4,064,914, 4,060,125, 3,906,604, 4,216,826 and 3,454,081. These enhanced boiling surface tubes are made in a variety of different ways which are well known to those skilled in the art. For example, such tubes may comprise annular or spiral cavities extending along the tube surface made by mechanical working of the tube. Alternatively, fins may be provided on the surface. So too, the tubes may be scored to provide ribs, grooves, a porous layer and the like.

U.S. Pat. No. 4,216,826 discloses a heat transfer tube for an exchanger that deforms radial fins to provide annular or spiral cavities around a heat transfer tube that is used for boiling applications.

Generally, the more efficient enhanced tubes are those having a porous layer on the boiling side of the tube which can be provided in a number of different ways well known to those skilled in the art. In one such method, as described in U.S. Pat. No. 4,064,914, the porous boiling layer is bonded to one side of a thermally conductive wall. The porous boiling layer is made of thermally conductive particles bonded together to form interconnected pores.

It is an object of this invention to provide a surface that uses trapped particulate material to provide nucleate boiling sites.

It is a further object of this invention to provide a boiling surface for a heat transfer tube that is readily producible on the inside or outside of heat transfer tubes.

Another object of this invention is to use unbonded particulate material in a boiling surface for a heat transfer tube.

BRIEF DESCRIPTION OF THE INVENTION

This invention is a heat transfer surface that physically traps particulate material into an arrangement of fins. Mechanical deformation physically retains the particles in the grooves between the fins. Flattening the tops of radially extending fins will restrict the opening of the grooves formed between fins to provide a chamber that holds the particulate material between the fins. Deformation of adjacent fins is restricted to a minimum to prevent continuous contact between the fins that would prevent fluid flow into the chamber and more preferably maintains a continuous opening between the adjacent fins that is just small enough to prevent particles from escaping from the chamber. The flattening of the fins preferably creates a contact pressure that holds the particles firmly in the grooves and against the fins for purposes of heat conduction.

The particles preferably fit snugly into the grooves formed between the fins. The points of contact between the particles and the surface of the grooves formed by the fins provide small crevices and cavities. These crevices and cavities serve as nucleation sites. Surface tension forces will typically draw a layer of liquid into the groove chamber. The combination of surface tension and the production of vapor provides a continuous circulation of liquid when the fins and particles are used in boiling applications.

Accordingly, this invention is in one embodiment a thin walled heat transfer body comprising a heat transfer surface defined by one side of a thin walled conductive body, a plurality of parallel fins fixed to the heat transfer surface, a plurality of channels defined by and extending between the fins and particulate material located in and retained in the channels by the fins.

In another embodiment, this invention is heat transfer tube comprising a heat transfer surface defined by a side wall of the tube, a plurality of parallel fins fixed to the side wall of the tube, a plurality of channels defined by and extending between adjacent fins; and particulate material located in and retained in the channels by said fins.

In a more specific embodiment this invention is a heat transfer tube for boiling liquids comprising a heat transfer surface defined by a side wall of the tube, a plurality of parallel fins formed on the side wall of said tube and a plurality of channels defined by and extending between adjacent fins, a restricted opening at the top of the chamber defined by an outer portion of the fins that extends transversely, and particulate material located in the chamber and having a size that prevents passage of the particulate material through the restricted opening The presence of the particulate material forms crevices and cavities that serve as nucleate boiling sites.

Additional objects, embodiments, and details of this invention are set forth in the following detailed description of the invention.

DETAILED DESCRIPTION OF THE INVENTION

The apparatus of this invention is broadly applicable to any heat exchange arrangement for the indirect exchange of heat between two fluids. The arrangement of this invention is particularly beneficial to any indirect heat exchange application that partially or fully vaporizes an at least partially liquid phase stream by contact with an enhanced boiling surface. Fluids that will contact the heat exchange surface containing the particles and fins typically include vaporizable liquids with sufficiently low fouling characteristics to permit sustained operation of the enhanced boiling surface.

The arrangement uses a heat transfer body that has parallel rows of fins attached thereto. The fins may be attached to the heat transfer body by any method, but are usually integrally formed from the heat transfer body. Spaces defined between the fins provide a chamber that retains the particulate material therein. The ends of the fins may be folded over or extended transversely to form a restricted opening at the top of the chamber to retain the particulate material or the fins may be pressed against the particles to mechanically retain the particulate material in the grooves between the fins.

Fins that may be used in this invention can take on a variety of configurations. Fin profiles may take on any form that will permit deformation of the fin to retain the particulate material. Acceptable fin profiles may also include fins that discontinuous in all three dimensions and provide what are commonly referred to as three dimensional "3D" fins. For example, fins that extend longitudinally on a tube can be made into 3D fins by slotting the fins radially at intervals along the length of the tube.

The heat transfer surface is most commonly form ed on the outside or the inside of heat transfer tube. The fins retaining the particles may have any configuration on the tube that will form suitable spaces for retaining the particulate material. Acceptable configurations include fins extending in a longitudinally along the length of the tube or circumferentially around the tube. Fins may also wrap around the tube to form spirals. As mentioned previously any of these fin arrangements may be slotted to provide 3D fins.

The fins for retaining the particles may extend on the inside or the outside of the tubes. Suitable method are known for cold drawing the previously mentioned fin configuration on the outside surface of heat transfer tubes. Cold drawing may also be used to form longitudinal fins along the inside surface of tubes. Other fin configurations may be formed on the inside of a tube by stamping a desired fin configuration in a plate and then rolling the plate into a tube shape.

Figure 1:
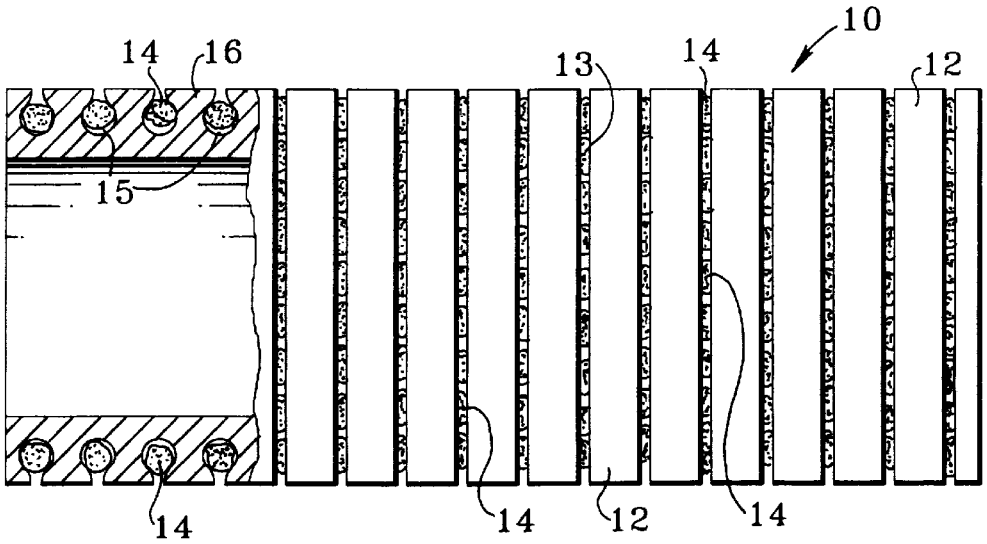
FIG. 1 is a partial cross section of a heat exchange tube having fins on the outside of the tube that is arranged in accordance with this invention.

The invention may be more readily understood by reference to the Figures. FIG. 1 shows a heat transfer tube 10 encircled by circumferentially extended fins 12. A slot 13 separates adjacent edges of the fins. The outer ends of the fins have been flattened to flare the ends 16 of the fins outward and give the fins transversely extended ends that define an annular chamber 15 for retaining particulate material therein. The particulate material extends around the entire circumference of the tube.

Figure 2:
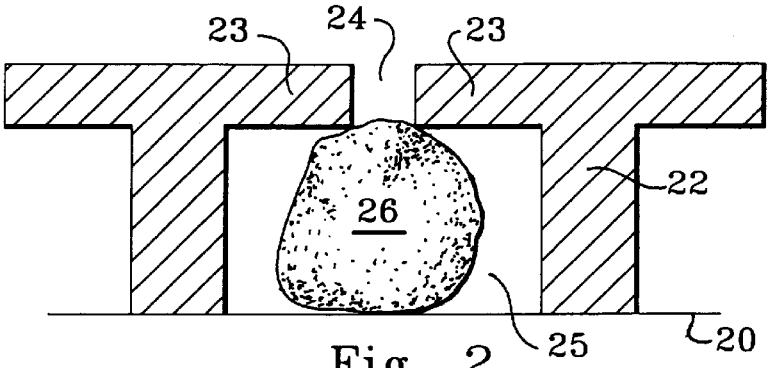
FIG. 2 is a schematic representation of a tube cross section showing the fin and particle arrangement on the outside wall of a tube.

FIG. 2 shows an idealized cross section of the heat transfer arrangement incorporating the fin and particle arrangement of this invention. A heat transfer surface 20 has overlapping fins 22 fixed thereon. The fins 22 are shown in a T shaped configuration with transversely extended ends 23, but may have any overlapping configuration that will retain the particles such as a Y-shape. Adjacent fins 22 define a slotted opening 24 between transversely extended ends 23. Slotted opening 24 provides an opening to a chamber 25. The chamber retains particles 26 that are held in contact with the ends of fins 22 and surface 20.

Figure 3:
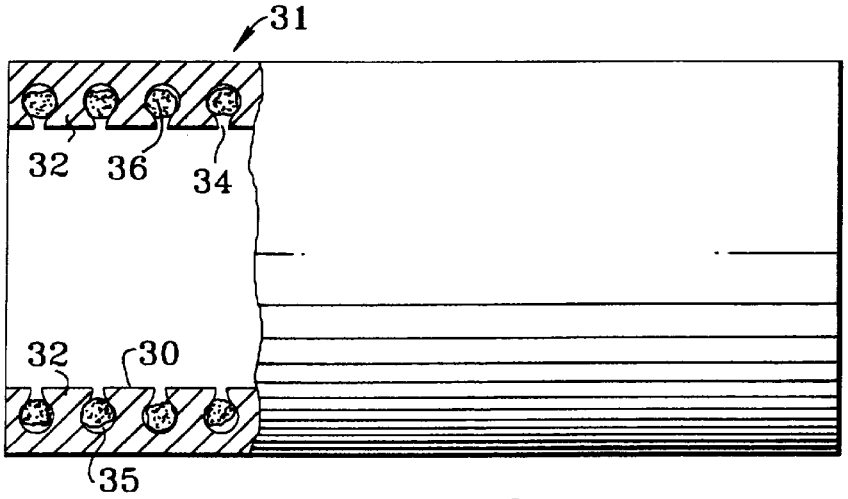
FIG. 3 is a partial cross section of a heat exchange tube having fins on the inside of the tube that is arranged in accordance with this invention.

FIG. 3 shows an idealized cross section of the heat transfer arrangement incorporating the fin and particle arrangement of this invention on the inside of a heat transfer tube. A heat transfer surface 30 of a heat transfer tube 31 has overlapping fins 32 fixed thereon. Adjacent fins 32 define a slotted opening 34 that provides an opening to a chamber 35. The chamber retains a particle 36 that is held in contact with the ends of fins 32 and surface 30.

Typical heat transfer tubes for this invention will have an outside diameter in a range of from ¾ to 1 inch. Fins for such tubes are typically space at a pitch of about 26 per inch, but may in some cases have a pitch as high as 50 per inch. For a 26 fin per inch configuration the fins will usually have a space between fins of about 0.020" at the base of the fins. The fins tapered to provide a slightly divergent angle between fins such that the opening between fins is greater at the ends of the fins. Therefore, a typical commercial finned tube has a space between the fins can accept particulate material on the order of 30 mesh or smaller. Preferably the invention will use relatively large particles, such that a single particle will essentially fill the space between the fins as depicted in the Figures.

This invention mechanically retains the particles in the grooves between the particles. Mechanical means of retaining the particles in the grooves of the fins must provide a secure fastening of the particles in the grooves. While it may be possible to use side pressure from the fins to deform the fins and particles into a locking arrangement, it is preferred that they are deformed to partially close the top of the chamber and lock the particles in a chamber between the fins.

The chamber and the resulting mechanical locking of the particles in place is most readily accomplished by deforming the fins into the configuration shown in FIGS. 1 and 3. A typical integrally formed fin tube arrangement will have a total fin height of about 0.060". The fin can be deformed up to about two third of its total height to leave a chamber height of roughly 0.020". The fins may be deformed by any well known method that will upset the ends of the fins to the desired degree. Common methods would include rolling the tubes through a series of dies to decrease the outside diameter of the tube. In the case of fins formed on the inside surface of a tube, the fins may be deformed by a pulling a mandrel having a larger diameter than the inner diameter of the tubes through the tubes to deform the tubes to the desired degrees once the particles have been applied to the spaces between the tubes.

The previously described stamping operation can be used to form the tube and fin arrangement of this invention on flat heat transfer plates. Where the fins are formed by stamping them into a plate, the fins may be deformed to retain particles by a further stamping operation after the particulate material has been inserted in the spaces between the fins.

The deformation of the fins must be controlled to prevent over deformation of the fins and closure of any gap between the fins. Intermittent closure of gap between the fins will leave enough open area for circulation of fluid into and out of the chamber. However it is preferred that the deformation of the fins provide a continuous slot between adjacent fins.

By having the particulate material in place when the fins are deformed, the deformation can be used to establish desirable contact pressure between the particle and the fins and the base of the tube or surface from which the fins extend. The particulate material may be applied to the space between the fins using an adhesive that is purged from the tube surface using a solvent after the mechanical retention of the particulate material is established. High contact pressure are desirable to deform the particle and the surface that it contacts. Local deformation around the particle will increase the length of micropores between the particulate and the surfaces that it contacts as well as improving conductive heat transfer to the particles.

The particulate material, heat transfer surface and fins may be formed from any heat conductive material that has adequate strength and corrosion resistance for the fluid contacting environment. In most cases the fins and the heat transfer surface will be formed from copper or carbon steel. The particulate material may be a material that is similar or dissimilar to the heat transfer surface and fins. It is generally anticipated that the particulate material will have the same composition as the fins and heat transfer surface. Copper is a preferred material for the heat transfer surface, fins and particles.

The most common application of this invention will be in heat transfer tubes. The arrangement of the fins and particulate material may be readily formed on the outside or inside of heat exchange tubes due to its high thermal conductivity.

What is claimed is:

1. A thin walled heat transfer body comprising:

a heat transfer surface defined by one side of a thin walled conductive body;

a plurality of parallel fins fixed to said heat transfer surface;

a plurality of channels defined by and extending between said fins; and particulate material located in and retained in said channels by said fins.

2. The apparatus of claim 1 wherein the outer end of said fins extend over said channel to retain said particulate material.

3. The apparatus of claim 2 wherein said outer ends of said fins form slots that extend parallel to said fins.

4. The apparatus of claim 3 wherein said slots are continuous.

5. The apparatus of claim 1 wherein said fins are integrally formed from the material of said body and said particulate material has the same composition as said fins and said body.

6. The apparatus of claim 5 wherein the material of said body, fins and particulate material is copper.

7. The apparatus of claim 1 wherein said particulate material has approximately the same width as said channels.

8. A heat transfer tube comprising:

a heat transfer surface defined by a side wall of said tube;

a plurality of parallel fins fixed to the side wall of said tube;

a plurality of channels defined by and extending between adjacent fins; and particulate material located in and retained in said channels by said fins.

9. The tube of claim 8 wherein the outer end of said fins extend over said channel to retain said particulate material.

10. The tube of claim 9 wherein said outer ends of said fins form slots that extend parallel to said fins.

11. The tube of claim 10 wherein said slots are continuous.

12. The tube of claim 8 wherein said fins are integrally formed from a base metal of said tube and said particulate material has the same composition as said fins and said tube.

13. The tube of claim 8 wherein said particulate material has approximately the same width as said channels.

14. The tube of claim 8 wherein said fins and particulate material are located on the outside diameter of said tube.

15. The tube of claim 8 wherein said fins extend circumferentially around said tube.

16. The tube of claim 8 wherein said fins and particulate material are located on the inside diameter of said tube.

17. A heat transfer tube for boiling liquids comprising:

a heat transfer surface defined by a side wall of said tube;

a plurality of parallel fins formed on the side wall and said fins having a top portion that extends transversely;

a plurality of channels defined by and extending between adjacent fins;

a restricted opening at the top of said chamber defined by the tops of said fins; and, particulate material located in said chamber and having a size that prevents passage of said particulate material through said restricted opening.

18. The tube of claim 17 wherein said outer ends of said fins form slots that extend parallel to said fins.

19. The tube of claim 17 wherein said particulate material has the same composition as said tube.

20. The tube of claim 17 wherein said particulate material has approximately the same width as said channels.

21. The tube of claim 17 wherein said fins extend circumferentially around said tube.

* * * * *